United States Patent [19]

Jarvis et al.

[11] 4,276,545

[45] Jun. 30, 1981

[54] DOOR ACTIVATED BURGLAR ALARM UTILIZING TIME DELAY

[75] Inventors: Clifford W. Jarvis, Clearwater; John E. Pearson, St. Petersburg, both of Fla.

[73] Assignee: Crime Fighter, Inc., Clearwater, Fla.

[21] Appl. No.: 77,904

[22] Filed: Sep. 24, 1979

[51] Int. Cl.[3] ..... G08B 13/08

[52] U.S. Cl. ..... 340/545; 340/528

[58] Field of Search ..... 340/545, 528

[56] References Cited

U.S. PATENT DOCUMENTS

| | | | |
|---|---|---|---|
| 3,286,250 | 11/1966 | Teitelbaum | 340/545 |
| 3,683,346 | 8/1972 | Horton | 340/528 |
| 3,803,576 | 4/1974 | Dobrzanski et al. | 340/528 |
| 4,114,147 | 9/1978 | Hile | 340/528 |
| 4,122,437 | 10/1978 | Petersen | 340/528 |
| 4,160,972 | 7/1979 | La Mell et al. | 340/545 |
| 4,170,005 | 10/1979 | Duke | 340/545 |

*Primary Examiner*—Glen R. Swann, III

*Attorney, Agent, or Firm*—William A. Newton

[57] ABSTRACT

A door-activated burglar alarm incorporates a firing capacitor that is charged by a battery during the quiescent state of the alarm. The firing capacitor will provide an additional current to fire a buzzer when the alarm is triggered, even if the battery is weak. (Less current is needed to maintain the buzzer, once it is fired). One embodiment provides exit and entry delays.

4 Claims, 2 Drawing Figures

DOOR ACTIVATED BURGLAR ALARM UTILIZING TIME DELAY

FIELD OF THE INVENTION

The present invention is directed toward a property protection alarm system for protecting property against any unauthorized intrusion.

DESCRIPTION OF PRIOR ART

Various conventional burglar alarm systems exist in the prior art in which various door and/or window switches activate buzzers or like signal-emitting devices. As shown in U.S. Pat. No. 3,286,250, various entrance and exit time delays have been built into the prior art burglar alarms. Generally, an exit time delay allows the proprietor of the premises to activate the burglar alarm while the door is open, without the annoyance of having the buzzer go off while the proprietor is leaving the premise. An entrance time delay allows a legitimate person to enter the guarded premises and deactivate the buzzer prior to it giving a false alarm. Other relevant prior art comprises U.S. Pat. Nos. 3,683,346; 4,114,147 and 4,122,437.

These prior art arrangements have several inherent disadvantages. First, they normally include very complex electronic and/or mechanical arrangements that add substantially to the cost. Although capacitors are used to create a sufficiently large current for firing the buzzer, these prior art arrangements use complex circuitry. Built in time delays also have resulted in complex circuitry. Secondly, the burglar alarm systems of the prior art have excessive standby current drains.

Accordingly, it can be readily seen that there is a need in the industry for a relatively inexpensive and reliable burglar alarm system which has a greatly simplified construction created by minimizing the number of active electronic components and which has an essentially zero standby current drain.

SUMMARY OF THE INVENTION

A first embodiment of the present invention is directed toward a burglar alarm system wherein a first capacitor is charged to an open circuit battery voltage, after an on-off switch is closed, thereby arming the system. A door switch is employed for activating a buzzer or like signal-emitting device and has a pair of terminals arranged to be in open and closed positions in response to a door being closed and opened, respectively. A controlled rectifier is operatively arranged for receiving a positive potential from a power source and becoming conductive to the buzzer, after receiving a triggering signal through the closed door switch to its gate. The capacitor acts as a low impedance/high current source to provide a high starting current required by the buzzer. The controlled rectifier continues to provide power to the buzzer, whether or not the door switch remains closed. Due to the buffing action provided by the capacitor, even batteries which are partially depleted or which have higher than normal internal impedance will usually be able to provide useful operation to the system. The burglar alarm system of the first embodiment of the present invention employs a novel configuration of suitable solid state and semiconductor devices to implement the various burglar alarm activation-controlling functions. By virtue of this novel configuration, the burglar alarm system of the present invention has a greatly simplified and reliable construction which is relatively inexpensive to produce and has essentially zero standby current drain.

The second embodiment of the present invention incorporates the above described features of the first embodiment, and further includes, using a unique and novel circuitry configuration, exit time delay circuitry. Until the door switch is allowed to open, as occurs when the door or entrance is closed, the system remains unarmed. Using a simple circuit arrangement, the capacitor will begin to charge after the door switch is opened. Hence, the proprietor does not have to worry about the buzzer going off until the door has been closed. Moreover, for a period of about 5 seconds, during which the capacitor is not sufficiently charged, the proprietor can reopen the door, and disarm the system with the on-off switch.

The second embodiment of the present invention also incorporates entrance time delay circuitry of a simple and reliable design wherein an authorized intruder can open the door and have preferably 7 to 10 seconds to disarm the system by opening the on-off switch.

BRIEF DESCRIPTION OF THE DRAWINGS

Further objects and advantages of the present invention will become apparent as the following description proceeds, taken in conjunction with the accompanying drawings in which.

DESCRIPTION OF PREFERRED EMBODIMENTS

Figure 1:
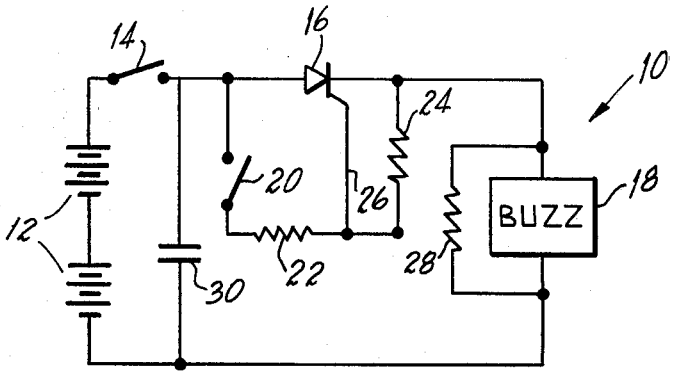
FIG. 1 is a schematic circuit diagram of the control circuitry of the first embodiment of the present invention.

Referring to FIG. 1, a first embodiment of a burglar alarm system, generally indicated by numeral 10, is shown. A pair of batteries 12, an "on-off" or first switch 14, a silicon controlled rectifier (SCR) 16 and a buzzer 18 are connected in series in an operating power circuit. More specifically, the first switch 14 is connected between the positive terminal of one of the batteries 12 and the anode of the SCR 16. The cathode of the SCR 16 is coupled to one of the terminals of the buzzer 18, with the other terminal of the buzzer 18 being coupled to the negative terminal of the other battery 12. The two series batteries 12 comprise the power supply means for the burglar alarm system 10. A door or second switch 20 is connected from the anode of the SCR 16 through resistors 22 and 24 to the cathode of the SCR 16. A conductor 26 is connected from the junction of resistors 22 and 24 to the gate of SCR 18. A resistor 28 shunts the buzzer 18. A capacitor 30 is connected between the negative terminal of the batteries 12 and the juncture of the first switch 14 with the anode of the SCR 16. The first switch 14 completes a capacitor charging circuit, while the second switch 20 allows the SCR 16 to complete a capacitor discharging circuit.

Referring to FIG. 1, in operation, the first switch 14 is manually closed to complete the capacitor charging circuit, thereby arming the burglar alarm system 10. The capacitor 30 is charged to the open circuit voltage of the two batteries 12. When the capacitor 30 is fully charged, the only current being drawn from the batteries 12 will be due to a minute capacitor leakage. Hence, the system 10 has an essentially zero standby current drain. The second switch 20 comprises a conventional magnetic switch circuit or like interruptable circuit which is attached to entrances, such as doors. The opening of the doors, such as during an attempted entry, will cause the normally opened second switch 20 to close. On closing, the second switch 20 will provide a current pulse from the batteries 12 through the resistor 22 to the gate of the SCR 16. The resistor 24 provides a low impedance load on the gate of SCR 18 to prevent turn on. As is well known, only when a certain critical value of the positive anode voltage is reached, will the SCR 16 switch from its normally non-conductive state to a highly conductive state, at which time the voltage across the SCR 16 drops to a low value. It is the current pulse to the gate of the SCR 16 that switches the same to its conductive state. Switching is very rapid and requires no moving parts. When the current pulse is provided through the resistor 22, the SCR 16 will begin to conduct, thereby connecting the batteries 12 and the capacitor 30 across the buzzer 18 and the resistor 28. The buzzer 18 requires an initially high starting current. Hence, the capacitor 30 acts as a low impedance, high current source to provide the high starting up current required by the buzzer 18. The shunt resistor 28 provides a path for enough current to keep the SCR 16 "latched on," despite intermittant current flowing through the buzzer 18. In other words, the current passing through the shunt resistor 28 prevents the anode current of the SCR 16 from being sufficiently interrupted so as to switch the SCR 16 to its non-conducting state. Once the SCR 16 has latched on, the circuit will continue to supply current to the buzzer 18, whether or not the second switch 20 remains closed. This is due to the gate of the SCR 16 having no further influence over the anode current, once the SCR 16 is switched to its conductive state. The buzzer 18 will continue to sound until the total battery supply voltage from the batteries 12 drops to about nine volts, which is half of the open circuit voltage. Due to buffering action provided by the capacitor 30, even if the batteries 12 are partially depleted or have a higher than normal internal impedance, the buzzer 18 will be properly operated. In order to disarm or deactivate the buzzer 18, the first switch 14 must be open, once the second switch 20 has been closed to activate the buzzer 18. Although resistor 22 and resistor 28 are desirable, under certain voltage conditions obvious to those skilled in the art, the circuit arrangement can operate without them.

Figure 2:
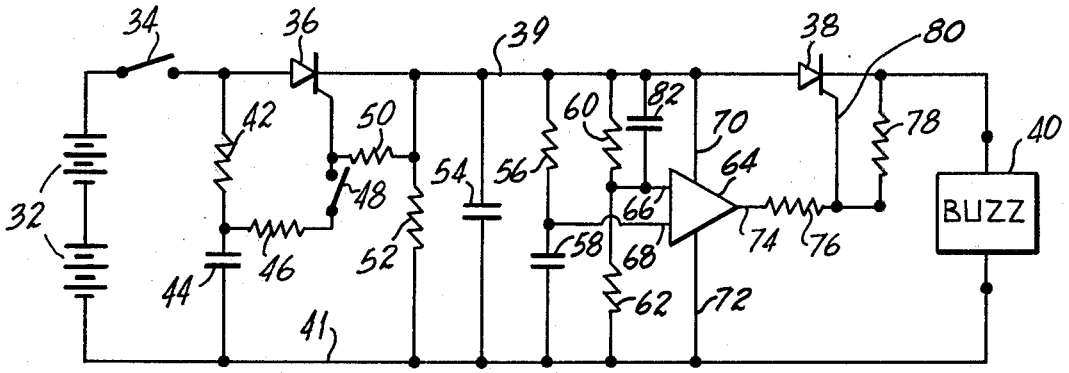
FIG. 2 is a schematic circuit diagram of the control circuitry of the second embodiment of the present invention incorporating time delays therein.

A second embodiment of the burglar alarm system 10 of the present invention is illustrated in FIG. 2. A pair of batteries 32, preferably nine volts each, are arranged in series to provide a positive potential through an on-off or first switch 34 to the anode of a first SCR 36. The cathode of the first SCR 36 is coupled to the anode of a second SCR 38 by line 39, the second SCR 38 in turn has its cathode connected to one of the terminals of a buzzer 40. The other terminal of the buzzer 40 is connected to the negative terminal of the batteries 32 by line 41. A resistor 42 and a capacitor 44 are in series with each other and are connected in parallel to the first switch 34 and the batteries 32. A resistor 46 is connected at the junction of the resistor 42 and the capacitor 44 through a door or second switch 48 to the gate of the first SCR 36. A resistor 50 is coupled between the gate and the cathode of the first SCR 36. A resistor 52 and a capacitor 54 are each connected between the lines 39 and 41 and are in parallel relationship to each other. A resistor 56 and capacitor 58 are in series relationship with respect to each other and are connected between lines 39 and 41. A resistor 60 and a resistor 62 are connected in series between the lines 39 and 41. An operational amplifier, comprising a high gain level comparator 64, has two input terminals 66 and 68. The first input terminal 66 of the comparator 64 is coupled with the juncture of the resistor 60 with the resistor 62. The second input terminal 68 of the comparator 64 is coupled to the juncture of the resistor 56 and the capacitor 58. The comparator 64 is connected in power supplying relationship to lines 39 and 41 by lines 70 and 72, respectively. The comparator 64 has an output terminal 74 coupled to the cathode of the second SCR 38 through a resistor 76 and a resistor 78, which is in series with resistor 76. A line 80 connects the gate of the second SCR 38 to the juncture of the resistor 76 with the resistor 78. Preferably, a capacitor 82 is connected between line 39 and the input terminal 66 of the comparator 64.

Referring to FIG. 2, in operation, the closing of the first switch 34 does not necessarily arm the system 10, but allows for the subsequent arming of the system 10 by closing the door. In other words, the system 10 will remain unarmed until the second switch 48 is opened by the closing of the door. More specifically, the capacitor 44 will be insufficiently charged through the capacitor charging circuit of the first switch 34 and the resistor 42, until the second switch 48 is opened. As long as the first switch 48 is closed, the voltage achieved by the capacitor 44 will be insufficient to provide the gating signal to the first SCR 36. Hence, the circuit of the resistors 46, 50 and 52 allows the proprietor to exit through the door, and close the door before the system is armed. Moreover, it will take approximately 5 seconds for the capacitor 44 to achieve a sufficient degree of charging to provide the necessary triggering signal to the first SCR 36 through its capacitor discharging circuit of the resistor 46 and the second switch 48. Hence, the capacitor 44 provides an exit time delay of sufficient duration, preferably 5 seconds, to allow the proprietor to re-enter the premises shortly after closing the door, and deactivate the system 10 by the first switch 34. An action such as attempted entry will cause the second switch 48 to close. On closing, the second switch 48 will provide a current pulse to the gate of the first SCR 36 through the resistor 46, with the use of the capacitor 44. The resistor 50 provides a low impedance load on the gate of SCR 16 to prevent turn on otherwise. When the current pulse is provided through the resistor 46, the first SCR 36 will begin to conduct, thereby connecting the batteries 32 across the resistors 52, 60, 62 and 56 and across the capacitors 58 and 54 and the comparator 64. The capacitor 54 acts as a low impedance/high current source to provide the high starting current required by the buzzer 40. As soon as the first SCR 36 latches on, the capacitor 58 begins to charge through the resistor 56. In a sensing circuit arrangement, the comparator 64 compares the voltage across the capacitor 58 to the voltage across the resistor 62, which is determined by the voltage divider network of the resistors 60 and 62. When the voltage across the capacitor 58 exceeds the voltage across the resistor 62, the output at the output terminal 74 of the comparator 64 goes from low to high, thereby providing a gating current through the resistor 76 to the gate of the second SCR 38. The time delay, provided by the above described R/C network of the resistor 56 and the capacitor 58, serves as an entrance delay of the alarm after tripping. This allows one to enter through the entrance or door having the second switch 38, and then to deactivate the system by opening the first switch 34 prior to the buzzer 40 going off. Preferably, the resistive value of the resistor 56 is set so as to create a time delay in the range of 7 to 10 seconds. Once the second SCR 38 has been turned on by the comparator 64, the circuit will continue to supply current for the buzzer 40, whether or not the second switch 48 remains closed. The buzzer 40 will continue to sound until the total battery supply voltage drops to about nine volts (one half the open circuit voltage). Due to the buffering action provided by the capacitor 54, even if the batteries 32 have been partially depleted or have a higher than normal internal impedance, they will usually be able to provide useful operation of the circuit. The first switch 34 must be opened to deactivate the circuit once the second switch 48 has activated it. Under certain voltage limitations, the capacitor 82 and the resistors 52 and 76 can be eliminated, although their use is desirable.

Although particular embodiments of the invention have been shown and described here, there is no intention to thereby limit the invention to the details of such embodiments. On the contrary, the intention is to cover all modifications, alternatives, embodiments, usages and equivalents of the subject invention as fall within the spirit and scope of the invention, specification and the appended claims.

What is claimed is:

1. In a burglar alarm system comprising a door switch electrically interconnected for activating a noise-emitting device and an operating circuit arranged to connect in series a power supply means having a positive terminal and a negative terminal, an on-off switch and the noise-emitting device, the improvement comprising:

the door switch having terminals arranged to be in open and closed positions in response to the door being closed and opened, respectively;

a controlled rectifier being interposed into the operating circuit so as to have an anode connected to the on-off switch for receiving a positive potential from the power supply means and a cathode interconnected to the noise-emitting device;

charging circuit for a capacitor comprising said capacitor being electrically coupled to the negative terminal of the power supply means and, through a first resistor, to a circuit point on the operating circuit between the on-off switch and the controlled rectifier;

a discharge circuit and exit time delay network comprising a second resistor being connected from a circuit point on the charging circuit between the first resistor and the capacitor, through the door switch, to the gate of the controlled rectifier, and further comprising a third resistor connected from the cathode of the controlled rectifier to the negative terminal of the power supply means, and further comprising a fourth resistor connected between the gate and the cathode of the controlled rectifier, whereby the capacitor will not be sufficiently charged to provide an operative triggering current pulse to the controlled rectifier until the on-off switch is closed and the door switch is opened by closing the door, and whereby the charging of the capacitor creates a predetermined exit time delay in arming the noise-emitting device after the door is closed.

2. In the burglar alarm system of claim 1, a second controlled rectifier being interposed into the operating circuit so as to have an anode connected to the cathode of the first-recited controlled rectifier and a cathode connected to the noise-emitting device;

a second charging circuit for a second capacitor comprising said second capacitor being coupled between the cathode of the first-recited controlled rectifier and the negative terminal of the power supply means;

entrance delay means for triggering the second controlled rectifier to a conductive state, said entrance delay means including a sensing circuit to provide a triggering signal after a predetermined time period.

3. In a burglar alarm system of claim 2, said sensing circuit including a third capacitor, said predetermined time period being measured from the time of the beginning of the charging of said third capacitor to a time when the third capacitor is charged to a predetermined level.

4. In a burglar alarm system of claim 2, said sensing circuit including a voltage comparator means having a pair of input terminals;

said sensing circuit further including a series network of a fifth resistor and a third capacitor connected from the anode of the first-recited controlled rectifier to the negative terminal of the power supply means and one of said pair of input terminals of said comparator being electrically connected to the juncture of said fifth resistor and said third capacitor;

said sensing circuit further including a series network of a sixth resistor and a seventh resistor connected from the anode of the first-recited controlled rectifier to the negative terminal of the power supply means and the other terminal of said pair of input terminals of said comparator being electrically connected to the juncture of the sixth resistor and the seventh resistor;

said comparator being adapted for providing said triggering signal to the gate of said second controlled rectifier when the voltage across said third capacitor exceeds the voltage at the juncture of the sixth resistor and the seventh resistor.

* * * * *